United States Patent [19]

Fujimura et al.

[11] Patent Number: 4,518,977

[45] Date of Patent: May 21, 1985

[54] HEAT-SENSITIVE RECORDING SHEET

[75] Inventors: Fumio Fujimura; Toshimi Satake; Makoto Iwaguro; Toshiaki Minami, all of Tokyo, Japan

[73] Assignee: Jujo Paper Co., Ltd., Tokyo, Japan

[21] Appl. No.: 531,173

[22] Filed: Sep. 8, 1983

[30] Foreign Application Priority Data

Sep. 14, 1982 [JP] Japan ..... 57-158821

[51] Int. Cl.[3] ..... B41M 5/18

[52] U.S. Cl. ..... 346/209; 346/216; 346/225; 427/150; 427/151

[58] Field of Search ..... 427/150–153; 282/27.5; 428/320.4–320.8, 411, 488, 537, 913, 914; 346/208, 209, 216, 217, 225

[56] References Cited

U.S. PATENT DOCUMENTS 3,937,864 2/1976 Kohmura et al. ..... 427/151
4,420,538 12/1983 Nakamura et al. ..... 282/27.5

FOREIGN PATENT DOCUMENTS 0116690 7/1982 Japan ..... 346/208

*Primary Examiner*—Bruce H. Hess
*Attorney, Agent, or Firm*—Koda and Androlia

[57] ABSTRACT

A heat-sensitive recording sheet having a color-forming layer comprises a colorless basic dyestuff and an organic color-developing agent, in which the color-forming layer uses a bis-(4-hydroxyphenyl)sulfide compound as the color-developing agent which comprises a compound of particular structure. The sheet provides a superior water-proofness.

5 Claims, No Drawings

HEAT-SENSITIVE RECORDING SHEET

BACKGROUND OF THE INVENTION

1. Field of the Invention

This invention relates to a heat-sensitive recording sheet having an excellent water-proofness.

2. Prior Art

A heat-sensitive recording sheet which utilizes a thermal color-forming reaction occurring between colorless or pale-colored chromogenic dyestuff and phenolic material, or organic acid is disclosed, for example, in the Japanese Patent Publication Nos. 4160/1968 and 14039/1970, and in the Japanese Laid-Open Patent Application No. 27736/1973, and is now widely applied for the practical use.

In general, a heat-sensitive recording sheet is produced by applying the sheet surface with a coating which is prepared by individually grinding and dispersing the colorless chromogenic dyestuff and color-developing material such as phenolic substance into fine particles, mixing the resulting dispersions with each other, and then adding thereto binder, filler, sensitizer, slipping agent and other auxiliaries. When this sheet is heated, the coating causes instantaneously a chemical reaction which forms a color. In this case, different bright colors can be advantageously formed, depending upon selection of specific colorless chromgenic dyestuff.

These heat-sensitive recording sheets have been found in a wide range of applications, including medical or industrial measurement recording instruments, terminal printers of computer and information communication systems, facsimile equipments, printers of electronic calculators, electronic balance, automatic ticket vending machines and so on. As the application use has become broader, a heat-sensitive recording paper is now used in various types of tickets such as railroad tickets and admission tickets, price cards attached to the commercial goods, as well as labels. On the other hand, the water-proofness of the recorded images has also come up to a problem depending on the cases. Meanwhile, the heat-sensitive recording paper is generally very much unstable to the water content or highly humidic condition and may reduce the density of the developed color images or even eliminate the color images due to the deposition of the water dropletes. Such an unstableness against the water is a serious problem in promoting the application of the heat-sensitive recording paper.

SUMMARY OF THE INVENTION

It is a general object of this invention to provide a heat-sensitive recording sheet which has an extremely high water-proofness so that the developed color images are not eliminated even when immersed in the water.

The above-mentioned object is achieved by mixing a compound represented by the following general formula (II) into a color-forming layer using a bis-(4-hydroxyphenyl) sulfide compound represented by the following general formula (I) as a color-developing agent:

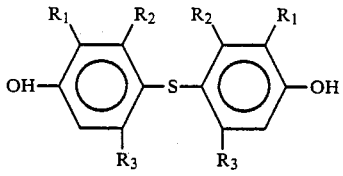

(I)

(in which $R_1$ represents an alkyl group with 1–4 carbon atoms or cyclohexyl group, and $R_2$ and $R_3$ individually represents an alkyl group with 1–10 carbon atoms or hydrogen atom provided that at least one of $R_2$ and $R_3$ is not hydrogen atom),

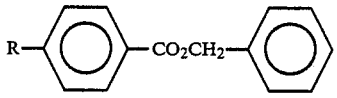

(II)

(in which R represents 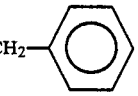 or 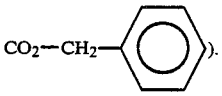 ).

DETAILED DESCRIPTION OF THE INVENTION

This invention will be described in detail. Bis-(4-hydroxyphenyl) sulfide compounds used in this invention include, for example, bis-(4-hydroxy-3-tert-butyl-6-methylphenyl)sulfide, bis-(4-hydroxy-2,5-dimethylphenyl) sulfide, bis-(4-hydroxy-2-methyl-5-ethylphenyl) sulfide, bis-(4-hydroxy-2-methyl-5-isopropylphenyl) sulfide, bis-(4-hydroxy-2,3-dimethylphenyl) sulfide, bis-(4-hydroxy-2,5-diethylphenyl)-sulfide, bis-(4-hydroxy-2,5-diisopropylphenyl) sulfide, bis-(4-hydroxy-2,3,6-trimethylphenyl) sulfide, bis-(2,4,5-trihydroxyphenyl) sulfide, bis-(4-hydroxy-2-cyclohexyl-5-methylphenyl)-sulfide, bis-(2,3,4-trihydroxy-phenyl) sulfide, bis-(2-tert-butyl-4,5-dihydroxyphenyl)-sulfide, bis-(4-hydroxy-2,5-diphenylsulfide, bis-(4-hydroxy-2-tert-octyl-5-methylphenyl)sulfide, etc.

As a compound represented by the above general formula (II), benzyl-p-benzyloxybenzoate and/or dibenzyl terephthalate are used. As colorless basic dyestuffs for use in this invention which are usually colorless or of pale color, various types of dyestuffs are well-known and can be used with no particular restriction. For instance, the colorless fluoran type dyestuffs include the following: 3-diethyl-amino-6-methyl-7-anilinofluoran (black), 3-(n-ethyl-p-toluidino)-6-methyl-7-anilinofluoran (black), 3-diethylamino-6-methyl-7-(o-,p-dimethylanilino)-fluoran (black), 3-pyrrolidino-6-methyl-7-anilinofluoran (black), 3-piperidino-6-methyl-7-anilionofluoran (black), 3-(n-cyclohexyl-n-methylamino)-6-methyl-7-anilinofluoran(black), 3-diethylamino-7-(metha-trifluoromethylanilino)-fluoran (black), 3-dibutylamino-7-(ortho-chloroanilino)-fluoran (black), 3-diethylamino-6-methyl-chlorofluoran (red), 3-diethylamino-6-methyl-fluoran (red), 3-cyclohexyl-amino-6-chlorofluoran (orange), crystal violet lactone (blue), 3-(4-diethylamino-2-ethoxyphenyl)-3-(1-ethyl-2-methylindol-3-yl)4-azaphthalide (blue), and 3-(4-diethylamino-2-ethoxyphenyl)-3-(1-ethyl-2-ethoxyphenyl)-3-(1-ethyl-2methylindol-3-yl)-7-azaphthalide.

The above organic color-developing agent and the colorless basic dyestuff, as well as the compound represented by the general formula (II), are pulverized in a grinder such as a ball mill, an attritor, a sand grinder or the like, or in an appropriate emulsifying apparatus into fine particles of less than several micron particle size and mixed with various types of additives depending on the purposes to prepare a coating solution. The coating solution may usually be mixed with binder such as polyvinyl alcohol, modified polyvinyl alcohol, hydroxyethyl-cellulose, methylcellulose, starches, styrene—maleic anhydride copolymer, vinylacetate—maleic anhydride copolymer, and styrene—butadiene copolymer, as well as organic or inorganic filler such as kaolin, calcined kaolin, diatomaceous earth, talc, titanium oxide, calcium carbonate, magnesium carbonate, and aluminum hydroxide. In addition, a releasing agents such as metal salt of fatty acid, lubricant such as wax, UV-absorber of benzophenone or triazole type, water-proofing agent such as glyoxal, dispersant, defoamer or the like can also be used. By coating the solution on a paper or various types of films, aimed heat-sensitive recording sheets can be obtained.

The kind and the amount of various ingredients for use in this invention are determined depending on the required performances and recording properties with no particular restriction. However, it is usually appropriate to use 3–10 parts of bis-(4-hydroxyphenyl)-sulfide compound, 3–12 parts of the compound represented by the above general formula (II), 1–20 parts of filler per one part of the colorless basic dyestuff, and 10–25 parts of the binder for the total solid content.

Further, since the oil-resistance effect can also be obtained by coating a water soluble binder on the chromophoric layer, demands for both the water-proofness and oil-resistance can be satisfied. The water soluble binders usuable herein include, for instance, polyvinyl alcohol, carboxy-modified polyvinyl alcohol, arylamide-modified polyvinyl alcohol, hydroxyethylcellulose carboxymethylcellulose and styrene—malic anhydride copolymer. By the combined use with the water proofing agent, a heat-sensitive recording paper which reacts faster can be obtained.

Since the recorded images on the heat-sensitive recording paper according to this invention is highly water-proof, it can well withstand for the use under the circumstance where the water drops are likely to splash on during the use or under highly humidic conditions. Furthermore, the heat-sensitive recording paper is also excellent in the adaptability for the high speed recording and the blightness stability of the background color. For instance, a typical conventional heat-sensitive recording paper using bisphenol-A as a color-developing agent and fatty acid amide in combination therewith develops the color at 60°–80° C. if it is intended to be adaptable to higher speed recording, and it cannot withstand against even slight temperature increase during storage and transportation of the heat-sensitive recording paper. However, the heat-sensitive recording paper according to this invention does not reduce its brightness of the background under the temperature condition of 60°–80° C. and can provide developed color images at high density even in the high speed recording.

This invention will be described more specifically with an example.

EXAMPLE 1

Solution A (liquid dispersion of dyestuff)

| | |
|---|---|
| 3-diethylamino-6-methyl-(p-chloro-anilino) fluoran | 1.5 parts |
| 10% aqueous solution of polyvinyl alcohol | 3.4 parts |
| Water | 1.9 parts |

Solution B (liquid dispersion of color-developing agent)

| | |
|---|---|
| Bisphenol A | 6 parts |
| Aqueous 10% solution of polyvinyl alcohol | 15 parts |
| Water | 9 parts |

Solution C (liquid dispersion of color-developing agent)

| | |
|---|---|
| Bis-(4-hydroxy-3-t-butyl-methylphenyl)sulfide | 1.0 parts |
| Aqueous 10% solution of polyvinyl alcohol | 2.5 parts |
| Water | 1.5 parts |

Solution D

| | |
|---|---|
| Stearic acid amide | 5 parts |
| 10% aqueous solution of polyvinyl alcohol | 12.5 parts |
| Water | 7.5 parts |

Solution E or F

The liquid dispersion in which benzyl p-benzyloxybenzoate or dibenzyl terephthalate is used respectively instead of stearic acid amide in Solution D.

Each of the solutions having the foregoing compositions was ground in a ball mill into 3-micron particle size. Thereafter, the liquid dispersions was mixed at a ratio shown in Table 1 to form each of the coating solutions.

TABLE 1

Compositions of coating solution in Example 1

| | Comparative Example | | | | | This invention | |
|---|---|---|---|---|---|---|---|
| | 1 | 2 | 3 | 4 | 5 | 1 | 2 |
| Solution A | 6,8 | 6,8 | 6,8 | 6,8 | 6,8 | 6,8 | 6,8 |
| Solution B | 30 | 30 | 30 | — | — | — | — |
| Solution C | — | — | — | 30 | 30 | 30 | 30 |
| Solution D | 25 | — | — | 25 | — | — | — |
| Solution E | — | 25 | — | — | 25 | 25 | — |
| Solution F | — | — | 25 | — | — | — | 25 |
| | — | — | — | — | — | — | — |
| Liquid dispersion of 50% calcium carbonate | 20 | 20 | 20 | 20 | 20 | 20 | 20 |

Each of the coating solutions was coated on one side of a paper of 50 g/m$^2$ so as to provide a coating amount of 6.0 g/m$^2$ and was dried. The sheet was treated by a supercalender so as to obtain a smoothness for 200–300 seconds. The results of the quality performance test carried out for the thus obtained black-color-developed heat-sensitive redording sheets are shown in Table 2.

TABLE 2

| Test No. | Feature of the blend | Optical density(1) | Stability of brightness of background: 80° C., 5 sec(2) | Stability of brightness of background: 60° C., 24 hours | Water-proofness(4) |
|---|---|---|---|---|---|
| Comparative Example | | | | | |
| 1 | bisphenol-A, stearic acid amide | 0.65 | 0.34 | 0.15 | 0.18 |
| 2 | bisphenol-A, benzyl p-benzyloxybenzoate | 1.02 | 0.12 | 0.11 | 0.19 |
| 3 | bisphenol-A, dibenzyl terephthalate | 1.09 | 0.16 | 0.15 | 0.20 |
| 4 | bis-(4-hydroxy-3-t-butyl-methylphenyl)sulfide | 0.38 | 0.06 | 0.07 | 0.32 |
| 5 | bis-(4-hydroxy-3-t-butyl-methylphenyl)sulfide, stearic acid amide | 0.56 | 0.31 | 0.10 | 0.50 |
| This invention | | | | | |
| 1 | bis-(4-hydroxyl-3-t-butyl-methylphenyl)sulfide, benzyl p-benzyloxybenzoate | 1.01 | 0.06 | 0.08 | 0.98 |
| 2 | bis-(4-hydroxy-3-t-butyl-methylphenyl)sulfide, dibenzyl terephthalate | 1.15 | 0.06 | 0.08 | 1.02 |

NOTE (1) Optical density

Measured in a heat-sensitive facsimile apparatus, CP 6000, manufactured by TOSHIBA CORPORATION, using Macbeth densitometer for the portion evenly printed black under the condition of GIII-mode (using RD-104 amber filter, which is also used in other examples).

(2) Stability of brightness of background (80° C., 5 sec.)

The heat-sensitive recording sheets were pressed down for 5 seconds under pressure of 10 kg/cm$^2$ on the hot plate heated at 80° C., and the optical density of the pressed portion was measured by Macbeth densitometer.

(3) Stability of brightness of the background (60° C., 24 hrs.)

The heat-sensitive recording sheets were left for 24 hours under severe conditions of 60° C. and 45% RH, and the brightness of the background was measured by Macbeth densitometer.

(4) Water-proofness

The heat-sensitive recording sheets recorded by Note (1) were immersed in a certain amount of water for 64 hours and dried, and then the recorded area was measured by Macbeth densitometer.

As apparent from Table 2, the heat-sensitive recording sheets obtained by the combined use of bis-(4-hydroxy-3-t-butylmethylphenyl)sulfide and benzyl p-benzyloxybenzoate or dibenzyl terephthalate provide a superior water-proofness with little reduction in optical density even for immersion in the water. It is apparent that such a superior water-proofness is a characteristic in the combined use of two compounds of this invention under consideration of comparative examples.

Further, the heat-sensitive sheets of this invention provide an excellent optical density in high speed recording and superior stability of the brightness of the background. Particularly, the effect of a combined use of the bis-(4-hydroxyphenylsulfide) compound of this invention and dibenzyl terephthalate are prominent.

We claim:

1. A heat sensitive recording sheet having a color forming layer comprising a colorless basic dyestuff and an organic color-developing agent, said color-forming layer using a bis-(4-hydroxyphenyl) sulfide compound of the general formula (I) and a compound of the general formula (II) as a color-developing agent:

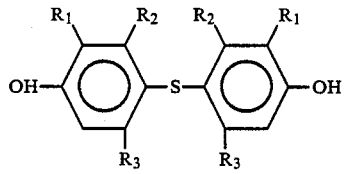

(I)

(in which $R^1$ represents an alkyl group with 1–4 carbon atoms or cyclohexyl group, and each of $R_2$ and $R_3$ represents an alkyl group with 1–10 carbon atoms or hydrogen atom, provided that at least one of $R_2$ and $R_3$ is not hydrogen atom),

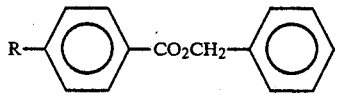

(II)

(in which R represents 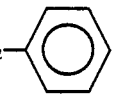 or 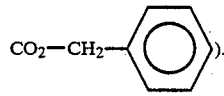 ).

2. A heat-sensitive recording sheet according to claim 1, in which the compound of the general formula (II) is dibenzyl terephthalate.

3. A heat-sensitive recording sheet according to claim 1, in which the bis-4-hydroxyphenol sulfide compound of the general formula (I) is at least one substance selected from the group consisted of bis-(4-hydroxy-3-tert-butyl-6-methylphenyl) sulfide, bis-(4-hydroxy-2,5-dimethylphenyl)sulfide, bis-(4-hydroxy-2-methyl-5-ethylphenyl)suflide, bis-(4-hydroxy-2-methyl-5-isopropylphenyl)sulfide, bis-(4-hydroxy-2,3-dimethylphenyl)-sulfide, bis-(4-hydroxy-2,5-diethylphenyl) sulfide, bis-(4-hydroxy-2,5-diisopropylphenyl)sulfide, bis-(4-hydroxy-2,3,6-trimethylphenyl)sulfide, bis-(2,4,5-trihydroxyphenyl)sulfide, bis-(4-hydroxy-2-cyclohexyl-5-methylphenyl) sulfide, bis-(2,3,4-trihydroxyphenyl)-sulfide, bis-(2-tert-butyl-4,5-dihydroxyphenyl)sulfide, bis-(4-hydroxy-2,5-diphenyl)sulfide, and bis-(4-hydroxy-2-tert-oxtyl-5-methylphenyl)sulfide.

4. A heat-sensitive recording sheet according to claim 1, in which the color-forming layer contains 3–10 parts by weight of bis-(4-hydroxyphenyl) sulfide compound, 3–12 parts by weight of the compound of the general formula (II), 1–20 parts by weight of filler per one part by weight of the colorless basic dyestuff, and 10–25 parts by weight of a binder for total solid content of the layer.

5. A heat-sensitive recording sheet according to claim 1, in which the color-forming layer further comprises glyoxal.

* * * * *